US010324413B2

(12) United States Patent
Nakamura et al.

(10) Patent No.: US 10,324,413 B2
(45) Date of Patent: Jun. 18, 2019

(54) IMAGE FORMING APPARATUS HAVING A PORTION TO PREVENT A PROCESS CARTRIDGE FROM BEING INSERTED WHEN THE PROCESS CARTRIDGE IS IN A PARTICULAR STATE

(71) Applicant: CANON KABUSHIKI KAISHA, Tokyo (JP)

(72) Inventors: Yuuki Nakamura, Mishima (JP); Makoto Hayashida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/594,721

(22) Filed: May 15, 2017

(65) Prior Publication Data

US 2017/0248909 A1 Aug. 31, 2017

Related U.S. Application Data

(62) Division of application No. 15/050,528, filed on Feb. 23, 2016, now Pat. No. 9,684,279.

(30) Foreign Application Priority Data

Feb. 27, 2015 (JP) ..... 2015-039588

(51) Int. Cl.
*G03G 21/16* (2006.01)
*G03G 21/18* (2006.01)
*G03G 15/08* (2006.01)

(52) U.S. Cl.
CPC ..... *G03G 21/1647* (2013.01); *G03G 15/0806* (2013.01); *G03G 21/1814* (2013.01); (Continued)

(58) Field of Classification Search
CPC ..... G03G 21/1821; G03G 21/1842
See application file for complete search history.

(56) References Cited

U.S. PATENT DOCUMENTS 7,933,534 B2 4/2011 Hoshi et al.
8,036,543 B2 10/2011 Yokomori et al.
(Continued)

FOREIGN PATENT DOCUMENTS

JP 2003-295596 A 10/2003
JP 2005-049525 A 2/2005
(Continued)

OTHER PUBLICATIONS

Office Action in Japanese Patent Application No. 2015-039588, dated Aug. 14, 2018 (with English translation).
(Continued)

*Primary Examiner* — Walter L Lindsay, Jr.
*Assistant Examiner* — Arlene Heredia
(74) *Attorney, Agent, or Firm* — Venable LLP

(57) ABSTRACT

An image forming apparatus in which an apparatus main body has: an insertion port through which a process cartridge cannot pass when an image bearing member and a developer bearing member are separated from each other and through which the process cartridge can pass when the image bearing member and the developer bearing member are in contact with each other; and guides that guide one of a first frame and a second frame when the process cartridge is inserted into the insertion port. The image forming apparatus has a separation mechanism that separates the image bearing member and the developer bearing member from each other when the process cartridge is further inserted after the other of the first frame and second frame has passed through the insertion port.

8 Claims, 7 Drawing Sheets

(52) U.S. Cl.
CPC ..... *G03G 21/1821* (2013.01); *G03G 21/1825* (2013.01); *G03G 21/1842* (2013.01)

(56) References Cited

U.S. PATENT DOCUMENTS

| | | | | |
|---|---|---|---|---|
| 8,180,251 | B2 | 5/2012 | Nakamura et al. | |
| 8,275,283 | B2 | 9/2012 | Uneme et al. | |
| 8,326,178 | B2 | 12/2012 | Nakamura et al. | |
| 8,401,441 | B2 | 3/2013 | Uneme et al. | |
| 8,682,211 | B2 | 3/2014 | Hoshi et al. | |
| 8,687,994 | B2 | 4/2014 | Nakamura et al. | |
| 8,913,920 | B2 | 12/2014 | Nakamura et al. | |
| 8,965,243 | B2 | 2/2015 | Hayasha | |
| 9,046,823 | B2 | 6/2015 | Satomura et al. | |
| 9,122,240 | B2 | 9/2015 | Hashimoto | |
| 9,128,417 | B2 | 9/2015 | Yamasaki et al. | |
| 9,164,424 | B2 | 10/2015 | Nakamura et al. | |
| 9,213,267 | B2 | 12/2015 | Hoshi et al. | |
| 9,519,264 | B2 * | 12/2016 | Maeshima ..... | G03G 21/1857 |
| 2011/0064459 | A1 | 3/2011 | Toba | |
| 2011/0303114 | A1 | 12/2011 | Katogi | |
| 2011/0311272 | A1 | 12/2011 | Nittani et al. | |
| 2014/0086627 | A1 | 3/2014 | Tanabe | |
| 2015/0010320 | A1 | 1/2015 | Komatsu et al. | |
| 2015/0063824 | A1 | 3/2015 | Kobayashi et al. | |
| 2015/0234325 | A1 | 8/2015 | Satomura et al. | |
| 2015/0277370 | A1 | 10/2015 | Maeshima et al. | |
| 2015/0355576 | A1 | 12/2015 | Yamasaki et al. | |
| 2016/0216686 | A1 | 7/2016 | Sato | |

FOREIGN PATENT DOCUMENTS

| | | | |
|---|---|---|---|
| JP | 2008-009295 | A | 1/2008 |
| JP | 2014-134788 | A | 7/2014 |

OTHER PUBLICATIONS

Office Action in Japanese Patent Application No. 2015-039588, dated Oct. 30, 2018 (with English translation).

* cited by examiner

IMAGE FORMING APPARATUS HAVING A PORTION TO PREVENT A PROCESS CARTRIDGE FROM BEING INSERTED WHEN THE PROCESS CARTRIDGE IS IN A PARTICULAR STATE

BACKGROUND OF THE INVENTION

Field of the Invention

The present invention relates to an image forming apparatus using an electrophotographic process, a process cartridge, and an apparatus main body for an image forming apparatus.

Description of the Related Art

A conventional process cartridge is known in which a photosensitive drum and a process means for forming a developer image on the photosensitive drum are integrated as a cartridge. The process cartridge can be attached to and detached from the apparatus main body of an image forming apparatus. The cartridge system enables the user to maintain the image forming apparatus by himself, without a servicemen.

When an electrostatic latent image is developed on a photosensitive drum, a contact development system is sometimes used in which developer is supplied to the photosensitive drum by bringing a development roller into contact with the photosensitive drum. In the contact development system, since the development roller and the photosensitive drum need to be brought into contact with each other, the development roller is biased with respect to the photosensitive drum.

However, where the state of contact of the development roller with the photosensitive drum is maintained for a long time, the development roller can be deformed, or a toner interposed between the development roller and the photosensitive drum can be damaged. As a result, image defects can occur. For this reason, the feature of separating the development roller and photosensitive drum from each other when no image is formed is widely used in process cartridges.

For example, a configuration has been suggested in which a process cartridge is mounted in the rotation axis direction of a photosensitive drum from an insertion port provided in an apparatus main body (Japanese Patent Application Publication No. 2008-9295 (JP 2008-9295 A)). In this invention, the development roller is withdrawn from the photosensitive drum in conjunction with the operation of pulling out the process cartridge from the apparatus main body. Further, the development roller is brought into contact with the photosensitive drum in conjunction with the operation of inserting the process cartridge into the apparatus main body of the image forming apparatus.

Further, an image forming apparatus has been suggested which is provided with a door for opening and closing the insert ion port for inserting a process cartridge into the apparatus main body, and by closing the door after the process cartridge has been inserted into the apparatus main body, the development roller and photosensitive drum are brought into contact or separated in conjunction with the operation of closing the door (JP 2005-49525 A).

However, in the invention disclosed in JP 2008-9295 A, the separated development roller is brought close to the photosensitive drum in the course of inserting the process cartridge into the insertion port. Therefore, the insertion port of the apparatus main body needs to have a shape that allows to pass therethrough both the process cartridge in a state in which the development roller and photosensitive drum are brought close to each other and the process cartridge in a state in which the development roller and photosensitive drum are separated from each other.

In this case, a clearance is present between the process cartridge and insertion port when the process cartridge passes through the insertion port. As a result, the process cartridge can be inserted into the insertion port in a wrong mounting posture, or the posture of the process cartridge can be unstable during the attachment/detachment operation of the process cartridge. As a result, the important components, such as the photosensitive drum, can come into contact with the apparatus main body and these important components can be damaged.

Meanwhile, in the invention disclosed in JP 2005-49525 A, a part is needed for bringing the development roller and photosensitive drum into contact with each other or separating them from each other in conjunction with the operation of closing the door. Therefore, the number of parts used in the image forming apparatus is increased, and the production cost of the image forming apparatus rises.

SUMMARY OF THE INVENTION

Accordingly, it is an objective of the present invention to provide a technique for separating the photosensitive drum and development roller from each other in conjunction with the operation of mounting the process cartridge on the image forming apparatus, without damaging the important components of the process cartridge.

Another object of the present invention is to provide an image forming apparatus in which a process cartridge is configured to be attachable to and detachable from an apparatus main body, the process cartridge having a configuration in which a first frame that supports an image bearing member bearing a developer image and a second frame that supports a developer bearing member supplying developer to the image bearing member are supported rotatably and the image bearing member and the developer bearing member can be brought into contact with each other and separated from each other, wherein the apparatus main body has:

an insertion port through which the process cartridge cannot pass when the image bearing member and the developer bearing member are separated from each other and through which the process cartridge can pass when the image bearing member and the developer bearing member are in contact with each other; and a guide that guides one of the first frame and the second frame when the process cartridge is inserted into the insertion port, the image forming apparatus having a separation mechanism that separates the image bearing member and the developer bearing member from each other when the process cartridge is further inserted after the other of the first frame and the second frame has passed through the insertion port.

Another object of the present invention is to provide a process cartridge attachable to and detachable from an apparatus main body of an image forming apparatus, the process cartridge comprising:

a first frame that supports an image bearing member bearing a developer image;

a second frame that supports a developer bearing member supplying developer to the image bearing member and that is connected to the first frame to be rotatable with respect to the first frame; and a portion-to-be-contacted that is provided at one of the first frame and the second frame, the process cartridge being configured such that the image bearing member and the developer bearing member can come into contact with each other and be separated from each other, wherein the process cartridge is mounted on the apparatus main body by insertion from an insertion port that is provided at the apparatus main body and that blocks the passage of the process cartridge when the image bearing member and the developer bearing member are separated from each other and allows the process cartridge to pass when the image bearing member and the developer bearing member are in contact with each other; and the other one of the first frame and the second frame is guided by a guide provided at the apparatus main body when the process cartridge is inserted into the insertion port, and when the process cartridge is further inserted into the apparatus main body after the one of the first frame and the second frame has passed through the insertion port, the portion-to-be-contacted comes into contact with a contact port ion provided at the apparatus ma in body, thereby separating the image bearing member and the developer bearing member from each other.

Another object of the present invention is to provide an apparatus main body of an image forming apparatus, the apparatus main body being configured such that a process cartridge can be attached to and detached from the apparatus main body, the process cartridge having a configuration in which a first frame that supports an image bearing member bearing a developer image and a second frame that supports a developer bearing member supplying developer to the image bearing member are supported rotatably and the image bearing member and the developer bearing member can be brought into contact with each other and separated from each other, the apparatus main body comprising:

an insertion port that blocks the passage of the process cartridge when the image bearing member and the developer bearing member are separated from each other and allows the process cartridge to pass when the image bearing member and the developer bearing member are in contact with each other;

a guide that guides one of the first frame and the second frame when the process cartridge is inserted into the insertion port; and a contact portion that separates the image bearing member and the developer bearing member from each other by contact with a portion-to-be-contacted provided at the other of the first frame and the second frame when the process cartridge is further inserted after the other of the first frame and the second frame has passed through the insertion port.

Further features of the present invention will become apparent from the following description of exemplary embodiments (with reference to the attached drawings).

DESCRIPTION OF THE EMBODIMENTS

An embodiment of the present invention is described hereinbelow with reference to the drawings. Dimensions, materials, shapes, and mutual arrangement of constituent components described in the embodiment could be changed, as appropriate, according to the configuration and various conditions relating to the apparatus using the invention, and the scope of the invention is not intended to be limited to the below-described embodiment.

The embodiment of the present invention is explained hereinbelow in detail with reference to the drawings.

<Configuration of Image Forming Apparatus>

Figure 1:
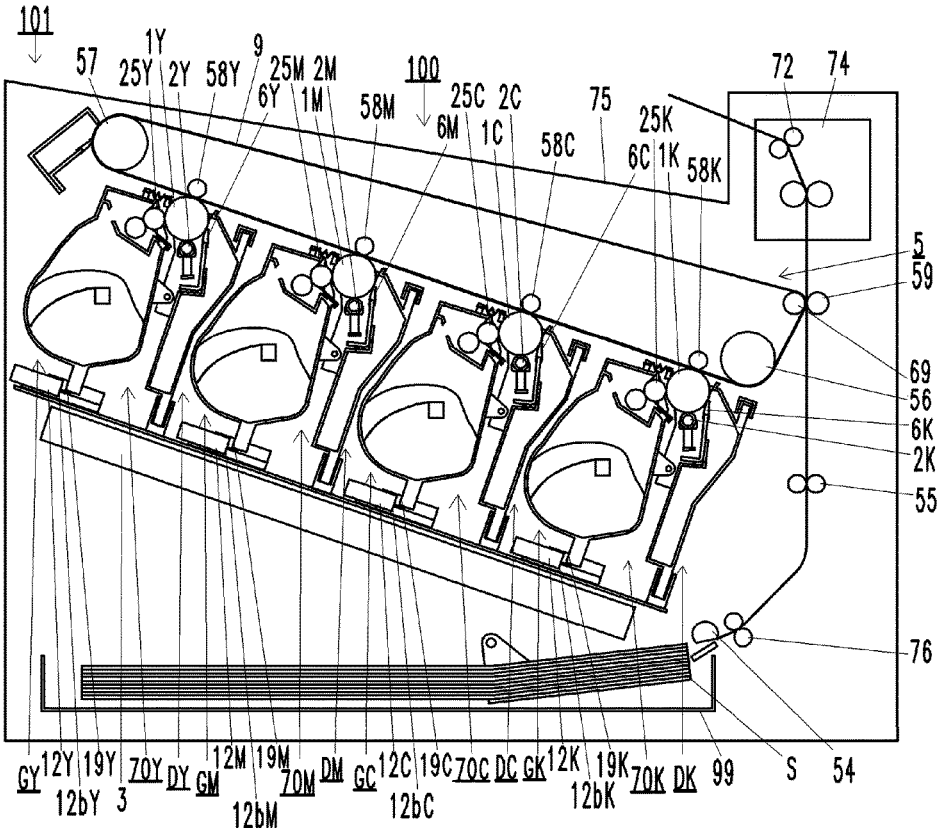
FIG. 1 is a schematic cross-sectional view of the image forming apparatus according to an embodiment.

Initially, the entire configuration of an image forming apparatus 100 is explained with reference to FIG. 1. FIG. 1 is a schematic cross-sectional view of an apparatus main body 101 of the image forming apparatus 100 and a cartridge 70. As depicted in FIG. 1, in the image forming apparatus 100, four detachable cartridges 70 (70Y, 70M, 70C, 70K) are provided together inside the apparatus main body 101 at an angle with respect to the horizontal direction. The configuration and operation of the cartridges 70 (70Y to 70K) are substantially the same, except that the colors of images formed on a recording medium S are different. For this reason, in the comprehensive explanation hereinbelow, indexes Y, M, C, K are omitted, unless specific distinction is required.

In the cartridge 70, process means such as photosensitive drums 1 (image bearing members) which are electrophotographic photosensitive drums, charging rollers 2, cleaning members 6, and development rollers 25 (developer bearing members) are arranged integrally. The charging rollers 2, the cleaning members 6, and the development rollers 25 are disposed on the periphery of the photosensitive drums 1. In the present embodiment, the rotation center axes of the photosensitive drums 1 and the rotation center axes of the development rollers 25 are parallel to each other.

The charging rollers 2 (2Y, 2M, 2C, 2K) charge uniformly the surface of the photosensitive drums 1 (1Y, 1M, 1C, 1K). The development rollers 25 (25Y, 25M, 25C, 25K) develop the electrostatic latent image, which has been formed on the photosensitive drums 1, with toners. Then, the cleaning members 6 (6Y, 6M, 6C, 6K) remove the toners remaining on the photosensitive drums 1 after the toner images (developer images) on the photosensitive drums 1 have been transferred onto the recording medium S. Further, a scanner unit 3 which performs selective exposure of the photosensitive drums 1 on the basis of image information and serves for forming the electrostatic latent images on the photosensitive drums 1 is provided below the cartridge 70.

A cassette 99 accommodating the recording medium S is mounted in the lower portion of the apparatus main body 101. Provided also is a recording medium transport means for transporting the recording medium S past a secondary transfer roller 59 or a fixing unit 74 to the upper side of the apparatus main body 101. More specifically, provided are a feed roller 54 that separates and feeds one by one the recording medium S located inside the cassette 99, a transport roller pair 76 that transports the recording medium S which has been fed, and a resist roller pair 55 for synchronizing the recording medium S with the electrostatic latent image to be formed on the photosensitive drums 1.

Further, an intermediate transfer unit 5 serving as an intermediate transfer means for transferring the toner images formed on the photosensitive drums 1 to the recording medium S is provided above the cartridge 70. The intermediate transfer unit 5 has primary transfer rollers 58 (58Y, 58M, 58C, 58K) provided opposite the photosensitive drums 1, an opposing roller 69 provided opposite the secondary transfer roller 59, a driver roller 56, and a driven roller 57. A transfer belt 9 is stretched over the driver roller 56, the driven roller 57, the primary transfer rollers 58, and the opposing roller 69.

The transfer belt 9 circulates while being in contact with all of the photosensitive drums 1, and the toner images formed on the photosensitive drums 1 are primary transferred to the transfer belt 9 as a result of voltage application to the primary transfer rollers 58. Where a voltage is applied to the opposing roller 69 disposed on the inner side of the transfer belt 9 and the secondary transfer roller 59, the toner images which have been primary transferred to the transfer belt 9 are transferred to the recording medium S.

When an image is formed on the recording medium S, the photosensitive drums 1 rotate and the rotating photosensitive drums 1 are uniformly charged by the charging rollers 2. The charged photosensitive drums 1 are then selectively exposed by the scanner unit 3. As a result, an electrostatic latent images are formed on the photosensitive drum 1. The electrostatic latent images formed on the photosensitive drums 1 are developed with the development rollers 25, thereby forming toner images of respective colors on each of the photosensitive drums 1.

Synchronously with the formation of the toner images, the resist roller pair 55 transports the recording medium S to the secondary transfer position at which the opposing roller 69 and the secondary transfer roller 59 come into contact with each other, with the transfer belt 9 being interposed therebetween. As a result of transfer bias voltage application to the secondary transfer roller 59, the color toner images on the transfer belt 9 are successively secondary transferred to the recording medium S. As a result, a color toner image is formed on the recording medium S. The recording medium S on which the color toner image has been formed is heated and pressurized by the fixing unit 74, thereby fixing the color toner image to the recording medium S. The recording medium S with the toner image fixed thereto is then released by a release roller 72 to a release unit 75. The fixing unit 74 is disposed in the upper portion of the apparatus main body 101.

<Process Cartridge>

Figure 2:
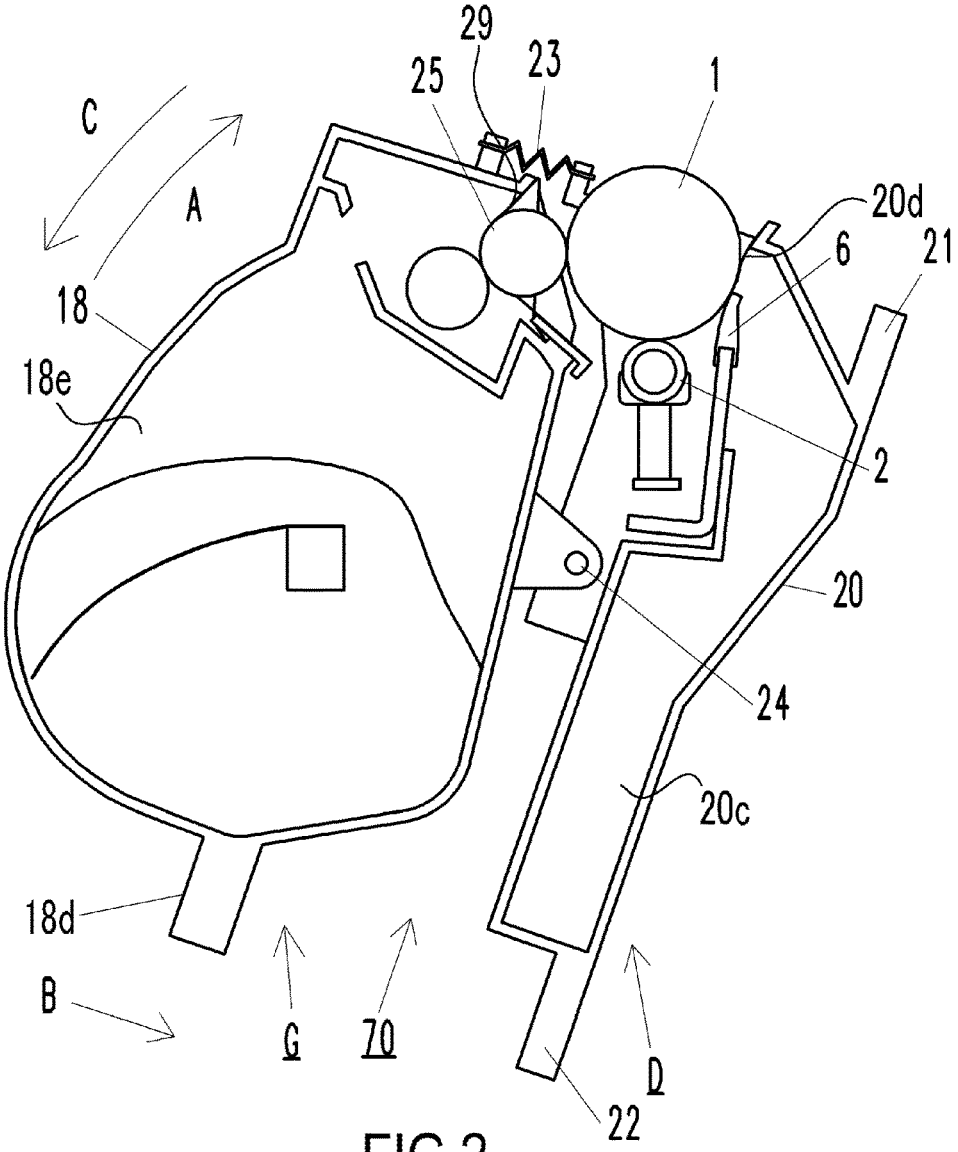
FIG. 2 is a schematic cross-sectional view of the process cartridge in a contact state.

The cartridge 70 is explained hereinbelow with reference to FIG. 2. FIG. 2 is a schematic cross-sectional view of the cartridge 70 in a state of image formation. The cartridge 70 is constituted by a cleaning unit D having a photosensitive drum 1 and serving as a cleaning device which is also a drum unit, and a development unit G having the development roller 25 as a development cartridge (development means). The drum unit is a unit having the photosensitive drum 1 (image bearing member), and the cleaning unit is a unit having the photosensitive drum 1 (image bearing member) and the cleaning means for cleaning the photosensitive drum 1. The development unit is a unit having the development means for developing the photosensitive drum 1 (image bearing member).

The cleaning unit D is provided with the photosensitive drum 1 which is configured to be rotatable, the charging roller 2, the cleaning member 6, and a cleaning frame 20 (first frame) supporting those members. The development unit 4 is provided with the development roller 25 which is configured to be rotatable and a development frame 18 (second frame) supporting the development roller.

As mentioned hereinabove, the charging roller 2 and the cleaning member 6 are disposed on the periphery of the photosensitive drum 1. The cleaning member 6 is constituted by an elastic member 7 formed from a rubber blade and a cleaning support member 8.

The elastic member 7 is provided such that the distal end thereof is in contact with the surface of the photosensitive drum 1 in the direction opposite to the rotation direction of the photosensitive drum 1. The removed matter, such as the residual toner, which has been removed by the cleaning member 6 from the surface of the photosensitive drum 1 falls into a removed toner chamber 20*c* serving as a housing section and is housed therein. Further, a scooping sheet 20*d* preventing the leakage of the removed toner in the removed toner chamber 20*c* is in contact with the photosensitive drum 1. Where drive power of a main body drive motor (not depicted in the figure), which is a driver source, is transmitted to the cleaning unit D, the photosensitive drum 1 is rotationally driven in response to the image forming operation. The charging roller 2 is rotationally mounted on the cleaning frame 20 through a charging roller bearing 28, pressed by a pressing member 46 towards the photosensitive drum 1, and rotationally driven by the photosensitive drum 1.

A toner feed roller 34 rotating in contact with the development roller 25, and a development blade 35 for controlling the layer thickness of the toner carried on the development roller 25 are disposed on the circumference of the development roller 25 of the development unit G. A leak preventing sheet 29 is arranged for preventing the toner from leaking from the development frame 31 which is in contact with the development roller 25. A toner housing chamber 18*e* of the development frame 18 is provided with a toner transport member 36 for stirring the toner housed therein and transporting the toner to the toner feed roller 34.

The development unit G is joined (connected) to the cleaning unit D to be rotatable about a mating shaft 24 fixedly supported on the cleaning frame 20 of the cleaning unit D. The development unit G is also biased in the direction C in FIG. 2 by a tension force of a compressed spring 23. Therefore, when an image is formed by the process cartridge 70, the development unit G rotates about the mating shaft 24, and the photosensitive drum 1 and the development roller 25 are in contact with each other.

Figure 5:
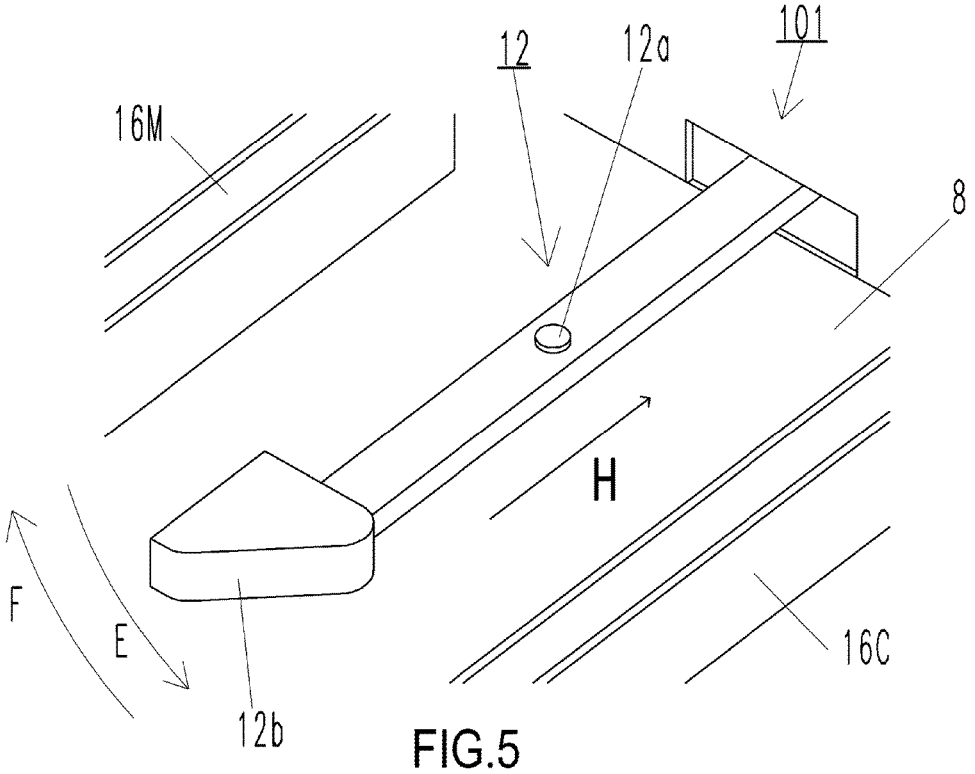
FIG. 5 is a schematic perspective view illustrating a separation lever provided at the apparatus main body.

The development frame 18 of the development unit G is also provided with a pressure surface 18*d* (section to be contacted), and the apparatus main body 101 is provided with a separation lever 12 (contact section) (see FIG. 5). When no image is formed, the separation lever 12 moves in the direction B in FIG. 2, while pushing the pressure surface 18*d*, thereby rotating the development unit G about the mating shaft 24 in the direction A in FIG. 2 and separating the photosensitive drum 1 and the development roller 25. In other words, in the cartridge 70, the photosensitive drum 1 and the development roller 25 can come into contact with each other and separate from each other. In the present embodiment, the mechanism having the separation lever 12 and the pressure surface 18*d* is assumed to be a separation mechanism. The separation mechanism can apply (application is possible) a force to the development frame 18 such as to separate the development roller 25 and the photosensitive drum 1.

With such a configuration of the cartridge 70, when an image is formed on the recording medium S, the development roller 25 and the photosensitive drum 1 are in contact with each other and the toner is supplied from the development roller 25 to the photosensitive drum 1. As a result, as mentioned hereinabove, the electrostatic latent image formed on the photosensitive drum 1 is developed. Meanwhile, when no image is formed on the recording medium S, the development roller 25 and the photosensitive drum 1 are separated from each other. As a result, the development roller 25 can be prevented from deformation, and the toner interposed between the development roller 25 and the photosensitive drum 1 can be prevented from damage.

<Attachment/Detachment of Cartridge to/from Image Forming Apparatus Main Body>

Figure 3:
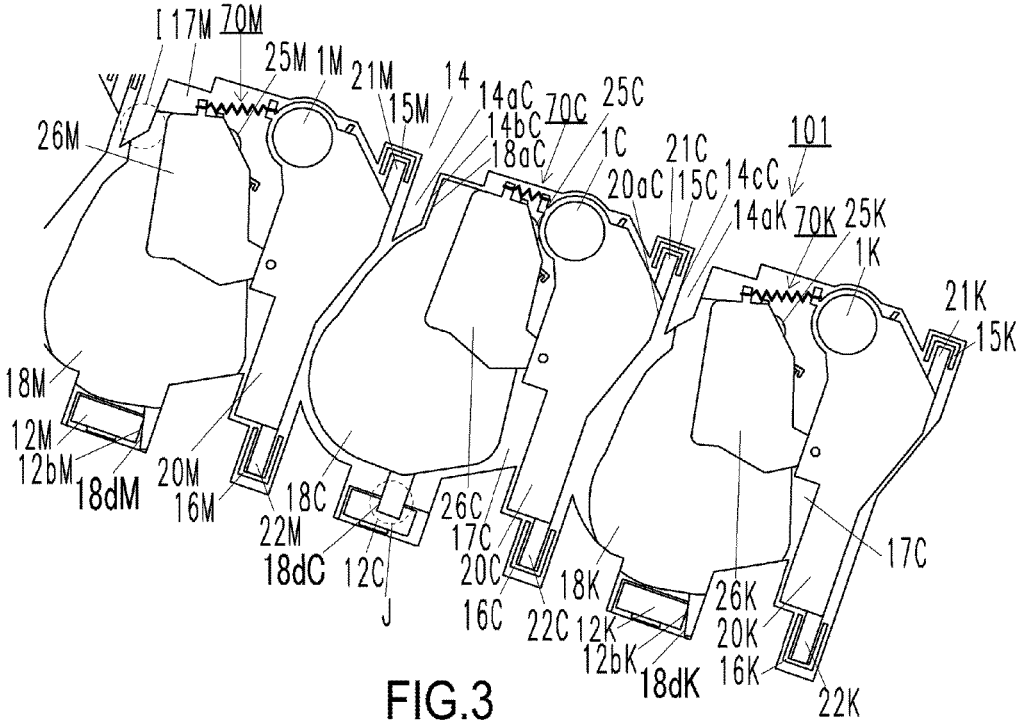
FIG. 3 is a schematic external appearance view of the process cartridge according to the embodiment.
Figure 4:
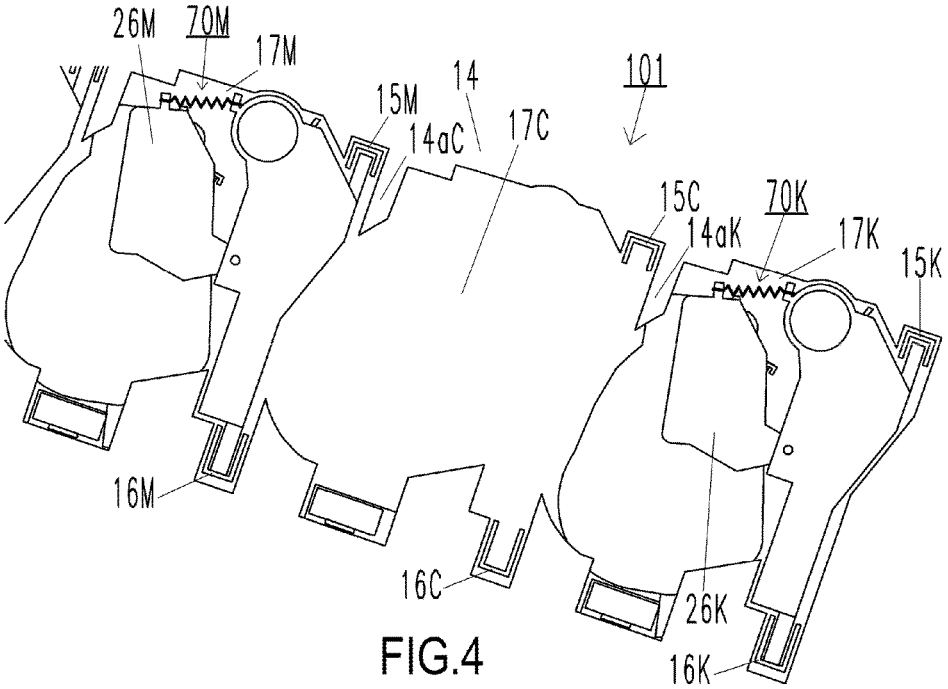
FIG. 4 is a schematic external appearance view illustrating an insertion port provided in the apparatus main body of the image forming apparatus.

The operation of attaching/detaching the cartridge to/from the apparatus main body 101 is explained hereinbelow with reference to FIG. 1 and FIGS. 3-6. FIG. 1 is a schematic cross-sectional view of the image forming apparatus of the present embodiment. FIG. 3 is a schematic external appearance view illustrating the state in which the cartridge 70 is mounted in the insertion port of the apparatus main body 101 of the image forming apparatus. FIG. 4 is a schematic external appearance view illustrating the insertion port provided in the apparatus main body of the image forming apparatus. FIG. 5 is a schematic perspective view illustrating the separation lever provided at the apparatus main body. FIGS. 6A to 6D are schematic diagrams illustrating the operation of mounting the process cartridge. FIGS. 3 and 4 show only components relating to the cartridges 70M and 70K adjacent to the cartridge 70C, but the case in which three cartridges are arranged is not limiting.

As mentioned hereinabove, the cartridge 70 is configured to be attachable to and detachable from the apparatus main body 101. The apparatus main body 101 is also provided with a door (not depicted in the figure). The opening of the door exposes the cover 14, an upper attachment/detachment guide 15 that guides an upper attachment/detachment guided member 21 when the cartridge is attached and detached, and a lower attachment/detachment guide 16 that guides a lower attachment/detachment guided member 22 when the cartridge 70 is attached and detached, as depicted in FIG. 3. Provided herein are the upper attachment/detachment guide 15 and the lower attachment/detachment guide 16 that guide the configuration that guides the cleaning frame 20 in the insertion direction (H direction). The upper attachment/detachment guide 15 and the lower attachment/detachment guide 16 are mounted on the front cover 14. An insertion opening 17 (insertion port) which is an opening for mounting the cartridge 70 inside the apparatus main body 101 is formed in the front cover 14.

The upper attachment/detachment guide 15 is in the concave shape opened in the downward direction, and the lower attachment/detachment guide 16 is in the concave shape opened in the upward direction. The upper attachment/detachment guided member 21 is guided by the upper attachment/detachment guide 15, and the lower attachment/detachment guided member 22 is guided by the lower attachment/detachment guide 16, thereby guiding the cartridge 70 when the cartridge 70 is inserted into the apparatus main body 101. Further, the upper attachment/detachment guide 15 and the lower attachment/detachment guide 16 align the cleaning frame 20 in the direction perpendicular to the insertion direction (H direction). As depicted in FIG. 3, the upper attachment/detachment guided member 21 and the lower attachment/detachment guided member 22 are provided at the cleaning unit D. The upper attachment/detachment guided member 21 is shaped to protrude upward, and the lower attachment/detachment guided member 22 is shaped to protrude downward.

<Mounting of the Cartridge>

When the cartridge 70 is mounted on the apparatus main body 101, the upper attachment/detachment guided member 21 of the cartridge 70 is placed along the upper attachment/detachment guide 15 of the apparatus main body 101, and the lower attachment/detachment guided member 22 is placed along the lower attachment/detachment guide 16. Then, the cartridge 70 is inserted in the axial direction (rotation center axis direction) (H direction) of the photosensitive drum 1. Further, the present embodiment is not configured to include a partition member between the adjacent cartridges 70. As a result, the spacing between the adjacent cartridges 70 can be reduced and the apparatus main body 101 can be miniaturized.

With the configuration in which no partition members are provided in the apparatus main body 101, a state can occur in which the upper attachment/detachment guided member 21 is not mounted along the upper attachment/detachment guide 15, and the lower attachment/detachment guided member 22 is not mounted along the lower attachment/detachment guide 16. Therefore, in such a case, the cartridge 70 is not introduced into the insertion opening 17 in a correct mounting posture, or the posture of the cartridge 70 cannot be stabilized during the attachment/detachment operation. As a result, in the worst-case scenario, an important component such as the photosensitive drum 1 comes into contact with the apparatus main body 101, and the important component can be damaged.

Accordingly, in the present embodiment, as depicted in FIGS. 3 and 4, the insertion opening 17 is shaped correspondingly to the outer shape of the cartridge 70 in a state in which the development roller 25 and the photosensitive drum 1 are in contact with each other. The outer shape of the cartridge 70, as referred to herein, is the outer shape of the cartridge 70 as viewed from the direction perpendicular to the insertion direction (H direction). As a result, the insertion opening 17 prevents the passage of the cartridge 70 in a state in which the photosensitive drum 1 and the development roller 25 are separated from each other and allows the passage of the cartridge 70 in a state in which the photosensitive drum 1 and the development roller 25 are in contact with each other. Thus, in the configuration of the present embodiment, the cartridge 70 is inserted into the insertion opening 17 in a state in which the photosensitive drum 1 and the development roller 25 are in contact with each other. Further, since the insertion opening 17 is shaped correspondingly to the outer shape of the cartridge 70 in a state in which the development roller 25 and the photosensitive drum 1 are in contact with each other, it can be seen that the cartridge 70 is more likely to be introduced in the insertion opening 17 in a correct mounting posture.

Further, in the present embodiment, as depicted in FIG. 3, partition sections 14*a* (14*a*C, 14*a*K) extending from the upper attachment/detachment guide 15 side to the lower attachment/detachment guide 16 side are provided at the front cover 14. The partition sections 14*a* are provided between the adjacent insertion openings 17 (17M to 17K in FIG. 4). The partition section 14*a* has a regulation surface 14*b* (14*b*C) and a regulation surface 14*c* (14*c*C). Since the partition sections 14*a* are provided in the present embodiment, the insertion opening 17C is shaped along the outer shape of the cartridge 70C. As a result, the upper attachment/detachment guided member 21C of the cartridge 70C is easily placed along the upper attachment/detachment guide 15C of the apparatus main body 101, and the lower attachment/detachment guided member 22C is easily placed along the lower attachment/detachment guide 16C.

Further, as a result of providing the partition section 14*a*C and the partition section 14*a*K, a surface-to-be-regulated 20*a*C of the cleaning frame 20C comes into contact with the regulation surface 14*c*C of the partition section 14*a*K when the cartridge 70C is inserted into the apparatus main body 101 in a wrong posture. Further, a surface-to-be-regulated 18*a*C of the development frame 18C comes into contact with the regulation surface 14*b*C of the partition section 14*a*C. As a result, the cartridge 70 can be prevented from being inserted into the apparatus main body 101 in a wrong posture. The state in which the upper attachment/detachment guided member 21 is placed along the lower attachment/detachment guide 15, and the lower attachment/detachment guided member 22 is placed along the lower attachment/detachment guide 16 will be referred to hereinbelow as the attachment/detachment posture of the cartridge 70.

<Operation of Separating Photosensitive Drum and Development Roller which is Performed in Conjunction with Cartridge Mounting Operation>

As depicted in FIG. 5, in the present embodiment, the separation lever 12 is provided at the apparatus main body 101 of the image forming apparatus 100. In a state in which the insertion of the cartridge 70C into the insertion opening 17 in the correct posture has been started, as depicted in FIG. 3 (the state C of the cartridge 70 in FIG. 3), as the cartridge 70 is inserted, the separation lever 12C is disposed at a position J overlapping the pressure surface 18*d*K.

As depicted in FIG. 5, the separation lever 12 is provided downstream in the mounting direction of the cartridge 70. The separation lever 12 is also attached to a bottom plate 68 in the apparatus main body 101 such as to be rotatable about a rotation center 12*a*. When the cartridge 70 is inserted into the apparatus main body 101, the separation lever 12 is fixed at a contact position rotated in the direction of arrow E in FIG. 5 by a cam mechanism (not depicted in the figure). As a result, as will be described hereinbelow, where the cartridge 70 is inserted into the apparatus main body 101, a pressure section 12*b* (inclined surface) in the separation lever 12 is in contact with the pressure surface 18*d* of the development frame 18 in the course of insertion of the cartridge 70 (FIGS. 6A to 6D). In the present embodiment, the pressure section 12*b* is an inclined surface inclined with respect to the insertion direction of the cartridge (H direction). The pressure surface 18*d* is also an inclined surface inclined with respect to the insertion direction of the cartridge (H direction).

Where the cartridge 70 is further inserted into the apparatus main body 101 in a state in which the pressure section 12*b* is in contact with the pressure surface 18*d*, the pressure surface 18*d* in the development frame 18 is pushed by the pressure section 12*b* in the separation lever 12, thereby separating the development roller 25 and the photosensitive drum 1 from each other. More specifically, as a result of the pressure surface 18*d* being pushed by the pressure section 12*b*, the development frame 18 rotates with respect to the cleaning frame 20, and the development roller 25 and the photosensitive drum 1 are separated from each other, as in the cartridge 70M and the cartridge 70C depicted in FIG. 3. In this case, a mechanism that has the development frame 18 and the separation lever 12 provided at the apparatus main body 101 and separates the development roller 25 from the photosensitive drum 1 is referred to as a separation mechanism.

To ensure smooth separation of the development roller 25 and the photosensitive drum 1 from each other, the pressure section 12*b* of the separation lever 12 is shaped to be inclined with respect to the mounting direction (H direction) of the cartridge 70, as depicted in FIG. 5. Further, the pressure surface 18*d* of the development frame 18 is also shaped to be inclined with respect to the mounting direction (H direction) of the cartridge 70. Meanwhile, in a state in which the separation lever 12 is fixed in a non-contact position which is a position rotated in the direction F in FIG. 5, the pressure applied by the pressure section 12*b* to the pressure surface 18*d* is released, as depicted in FIG. 2. As a result, the development roller 25 and the photosensitive drum 1 are brought into contact with each other by a tension force (urging force) of the compressed spring 23 (urging member), and an image can be formed.

As described hereinabove, when an image forming operation is not performed, it is preferred that the development roller 25 and the photosensitive drum 1 be separated from each other. Therefore, when the cartridge 70 is mounted on the apparatus main body 101, it is preferred that the development roller 25 and the photosensitive drum 1 assume a separated state at a point of time when the mounting of the cartridge 70 on the apparatus main body 101 has ended. Thus, in the present embodiment, the development roller 25 and the photosensitive drum 1 are separated from each other in conjunction with the operation of inserting the cartridge 70, in which the development roller 25 is in contact with the photosensitive drum 1, into the apparatus main body 101.

In a state in which the development roller 25 and the photosensitive drum 1 are separated from each other, the front cover 14 and the development frame 18 overlap in a region I, when viewed from the insertion direction of the cartridges 70M, 70K depicted in FIG. 3. In other words, the overlapping of the separation lever 12 and the pressure surfaces 18*d*M, 18*b*K, when viewed from the insertion direction of the cartridges 70M, 70K, is canceled. Further, in the present embodiment, the separation of the development roller 25 and the photosensitive drum 1 is started after the upstream end surface 18*b* of the development frame 18 in the insertion direction (H direction) of the cartridge 70 has passed the partition section 14*a* of the front cover (FIGS. 6A to 6D).

Figure 6A:
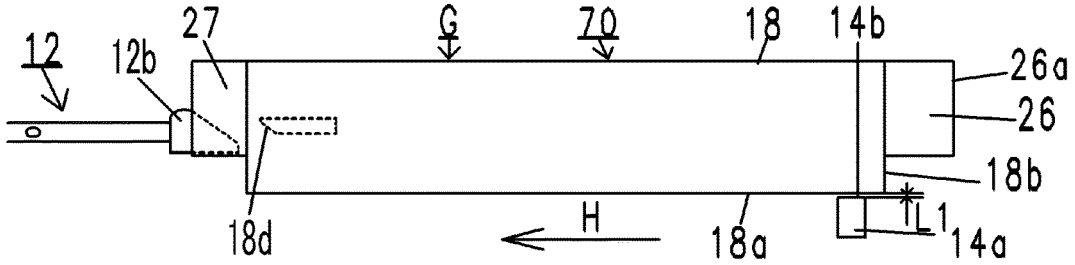
FIGS. 6A to 6D are schematic diagrams illustrating the operation of mounting the process cartridge.
Figure 6B:
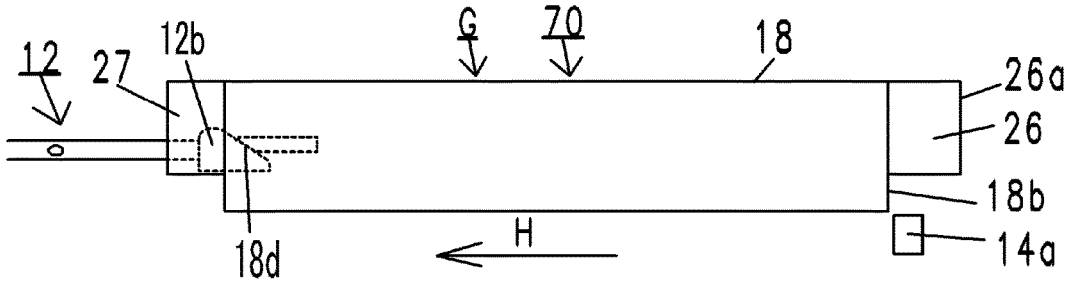

The series of operations of mounting the cartridge 70 on the apparatus main body 101 is explained hereinbelow with reference to FIGS. 6A to 6D. In a state in which the insertion of the cartridge 70 into the apparatus main body 101 has started, as depicted in FIG. 6A, the pressure surface 18*d* in the cartridge 70 is not in contact with the separation lever 12 in the apparatus main body 101. Since a gap L1 between the surface-to-be-regulated 18*a* in the development frame 18 and the regulation surface 14*b* in the front cover 14 is small, the cartridge 70 is easily inserted in the correct mounting posture, as indicated hereinabove. Where the cartridge 70 is further inserted into the apparatus main body 101 from the state depicted in FIG. 6A, the pressure surface 18*d* comes into contact with the separation lever 12, as depicted in FIG. 6B. At this time, in the insertion direction (H direction), the upstream end surface 18*b* of the development frame 18 is positioned downstream of the partition section 14*a* in the front cover 14.

Figure 6C:
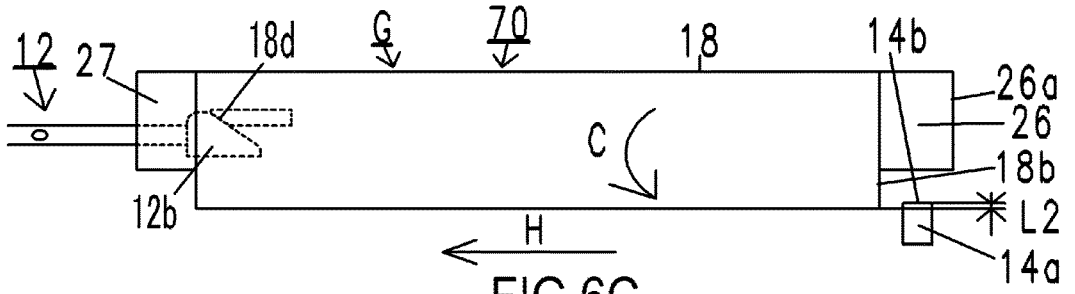

Further, in the present embodiment, a side member 26 and a side member 27 are provided at two ends of the development frame 18 in the insertion direction (H direction). Where the cartridge 70 is further inserted in the H direction from the state depicted in FIG. 6B, the pressure surface 18*d* is brought into contact and pressed against the separation lever 12, as depicted in FIG. 6C. The pressure surface 18*d* of the development frame 18 slides along the separation lever 12. As a result, the development unit G rotates in the direction of arrow B in FIGS. 6A to 6D, and the development roller 25 and the photosensitive drum 1 are separated from each other.

Figure 6D:
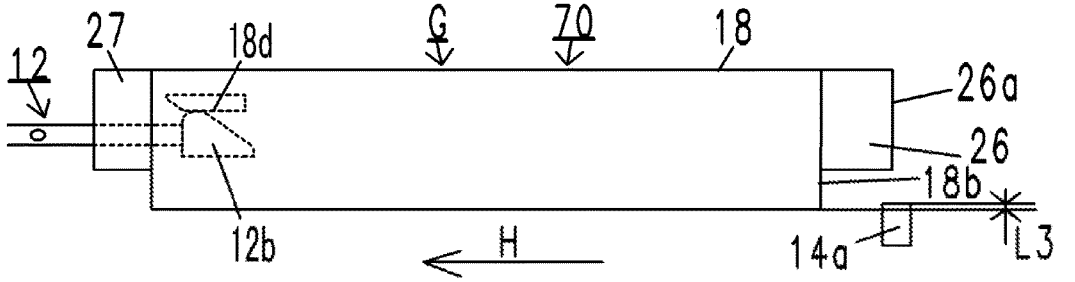

At this time, the upstream end surface 18*b* is positioned downstream, in the H direction, of the partition section 14*a* of the front cover 14. In other words, in the present embodiment, the photosensitive drum 1 and the development roller 25 are separated from each other by further inserting the cartridge 70 into the apparatus main body 101 after the development unit G has passed through the insertion opening 17. Further, since the development unit G rotates with respect to the cleaning unit D, part of the upstream end surface 18*b* and the partition section 14*a* overlap when viewed in the insertion direction (H direction) of the cartridge 70 (L2). Where the cartridge 70 is further inserted in the H direction from the state depicted in FIG. 6C, the mounting of the cartridge 70 on the apparatus main body 101 is completed. In this case, as depicted in FIG. 6D, the pressure surface 18*d* is further pushed by the separation lever 12, thereby further separating the development roller 25 from the photosensitive drum 1. As a result, the overlap width L3 of the part of the upstream end surface 18*b* and the partition section 14*a* increases by comparison with L2, when viewed in the insertion direction (H direction) of the cartridge 70.

<Removal of Cartridge>

Meanwhile, when the cartridge 70 is removed from the apparatus main body 101, the cartridge 70 is pulled out in the direction opposite to the insertion direction (H direction) of the cartridge 70. Where the pull-out of the cartridge 70 from the apparatus main body 101 is started, the pressure surface 18*d* slides along the separation lever 12, and the development roller 25 gets closer to the photosensitive drum 1. At a timing at which the upstream end surface 18*b* in the development frame 18 passes through the insertion opening 17, the development roller 25 comes into contact with the photosensitive drum 1. In other words, contrary to the case in which the cartridge 70 is inserted, the development roller 25 and the photosensitive drum 1 approach each other in conjunction with the operation of pulling the cartridge 70 out of the apparatus main body 101. In a state in which the upstream end surface 18*b* passes through the insertion opening 17, the development roller 25 and the photosensitive drum 1 come into contact with each other.

<Mechanism of Cartridge Mounting Operation>

Figure 7A:
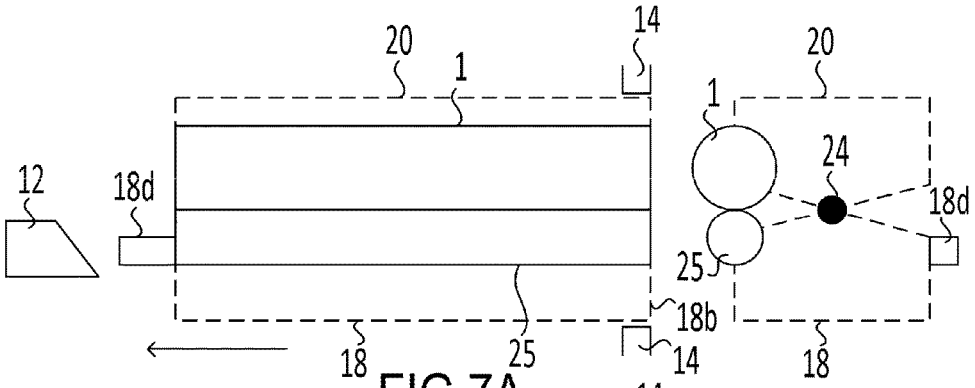
FIGS. 7A to 7C are schematic diagrams illustrating the mechanism performing the operation of mounting the process cartridge.
Figure 7B:
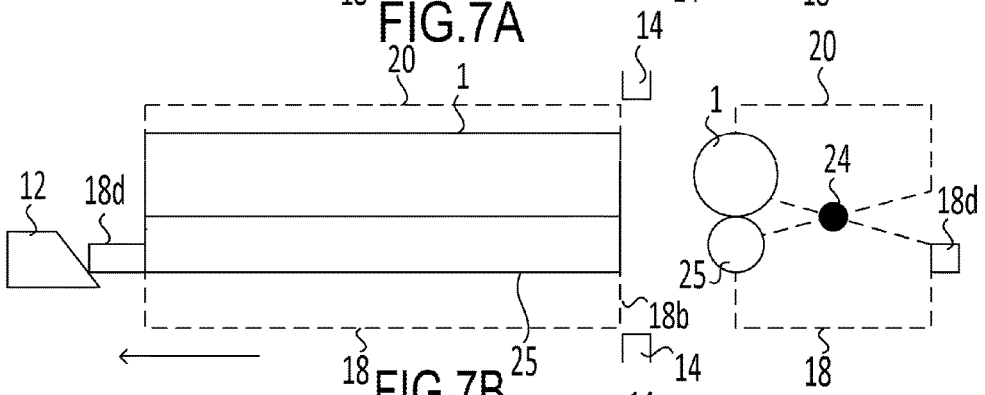
Figure 7C:
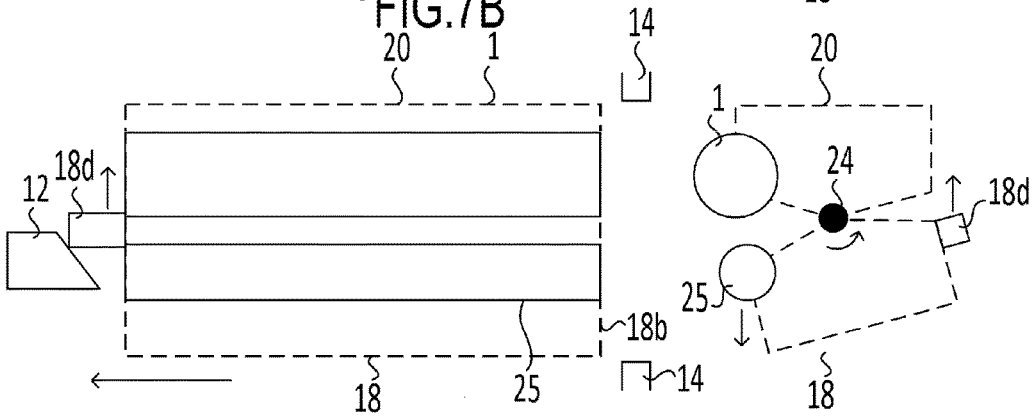

The mechanism realized when the cartridge 70 is mounted on the apparatus main body 101 is explained hereinbelow. FIGS. 7A to 7C are schematic diagrams illustrating the mechanism realized when the cartridge 70 is mounted on the apparatus main body 101. In the left drawings in FIGS. 7A to 7C, the operation of inserting the cartridge 70 is viewed from above the image forming apparatus 100, and in the right drawings, the operation of inserting the cartridge 70 is viewed from the insertion direction of the cartridge 70. When the insertion of the cartridge 70 into the apparatus main body 101 is started, the state depicted in FIG. 7A is assumed. In this state, the pressure surface 18*d* in the development frame 18 is not yet in contact with the separation lever 12 provided at the apparatus main body 101.

Where the cartridge 70 is further inserted into the apparatus main body 101 from the state depicted in FIG. 7A, the pressure surface 18*d* comes into contact with the separation lever 12 at a timing at which the upstream end surface 18*b* of the development frame 18 passes through the insertion opening 17, as depicted in FIG. 7B. Where the cartridge 70 is further inserted into the apparatus main body 101 from the state depicted in FIG. 7B, the pressure surface 18*d* is pushed by the separation lever 12, as depicted in FIG. 7C. As a result of the pressure surface 18*d* provided at the development frame 18 being pushed by the separation lever 12, the development frame 18 rotates with respect to the cleaning frame 20 and the development roller 25 separates from the photosensitive drum 1.

As described hereinabove, in the present embodiment, the apparatus main body of the image forming apparatus is provided with the insertion port such that the process cartridge cannot pass therethrough when the image bearing member and the developer bearing member are separated from the each other and such that the process cartridge can pass therethrough when the image bearing member and the developer bearing member are in contact with each other. The image bearing member and the developer bearing member are separated from each other by the separation mechanism, which is provided at the apparatus main body, in conjunction with the operation of further inserting the process cartridge after the first frame or second frame in the process cartridge has passed through the insertion port.

As a result of the image bearing member and developer bearing member being separated when the process cartridge in inserted into the apparatus main body, the toner interposed between the development roller and the photosensitive drum is prevented from damage and the development roller is prevented from deformation. Further, since the insertion port is in the shape described hereinabove, it can be seen that the cartridge is easily introduced into the insertion port in the correct mounting posture. The important components of the process cartridge are prevented from damage, and the photosensitive drum and development roller can be separated in conjunction with the operation of mounting the process cartridge on the image forming apparatus.

Further, in the present embodiment, the insertion port has a shape corresponding to the shape of the process cartridge, as viewed from the direction in which the process cartridge is inserted, in a state in which the image bearing member and developer bearing member are in contact with each other. As a result, the effect of introducing the cartridge into the insertion port in the correct mounting posture can be further enhanced.

Further, in the present embodiment, the configuration is described in which the process cartridge is attached/detached to/from the apparatus main body in a state in which the door of the apparatus main body is opened, but the attachment/detachment of the process cartridge may be also performed in conjunction with the operation of closing the door.

Further, in the present embodiment, the cleaning frame is guided by a guide provided at the apparatus main body, and the development frame rotates with respect to the cleaning frame. However, the cleaning frame is not necessarily required to be guided by the guide. For example, the configuration may be used in which the development frame is guided by the guide, and the cleaning frame rotates with respect to the development frame. In another possible configuration, one of the cleaning frame and development frame is guided by the guide and the other of the cleaning frame and development frame rotates.

Further, in the present embodiment, the pressure surface is provided at the development frame, but such a configuration is not limiting. The pressure surface may be provided, for example, at the cleaning frame.

Further, in the present embodiment, the cartridge is guided in the insertion direction as a result of the cleaning frame being guided in the cartridge insertion direction by the upper attachment/detachment guide and lower attachment/detachment guide. However, it is not always necessary that the cleaning frame be guided. For example, the cartridge may be guided in the cartridge insertion direction by guiding the development frame.

Further, in the present embodiment, a portion in the separation lever pushing the pressure surface is inclined with respect to the insertion direction of the cartridge, and the portion of the pressure surface pushed by the separation lever is inclined with respect to the insertion direction of the cartridge. However, such a configuration is not necessarily limiting. For example, the inclined surface may be provided at either one of the portion of the separation lever that pushes the pressure surface and the portion of the pressure surface that is pushed by the separation cover.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039588, filed Feb. 27, 2015 which is hereby incorporated by reference herein in its entirety.

What is claimed is:

1. An image forming apparatus comprising:

an apparatus main body; and a process cartridge configured to be attachable to and detachable from the apparatus main body, the process cartridge having a first unit in which an image bearing roller for bearing a developer image is supported rotatably and a second unit in which a developer bearing roller for bearing developer is supported rotatably, the process cartridge being capable of having a first state in which the image bearing roller and the developer bearing roller contact each other and a second state in which the image bearing roller and the developer bearing roller are spaced from each other, wherein the apparatus main body includes:

an insertion opening into which the process cartridge is inserted in a case where the process cartridge is attached to the apparatus main body; and a preventing portion configured (i) to prevent the process cartridge in the second state from being inserted into the insertion opening by contacting a part of the process cartridge, and (ii) to allow the process cartridge in the first state to be inserted into the insertion opening in the case where the process cartridge is attached to the apparatus main body, wherein the process cartridge is inserted into the insertion opening in a direction of a rotational axis of the image bearing roller, and the preventing portion is arranged (i) so as to overlap, when viewed in the direction of the rotational axis of the image bearing roller, with the part of the process cartridge in the second state, and (ii) so as not to overlap, when viewed in the direction of the rotational axis of the image bearing roller, with the part of the process cartridge in the first state.

2. The image forming apparatus according to claim 1, wherein the insertion opening has a shape corresponding to the shape of the process cartridge in the first state when viewed in the direction in which the process cartridge is attached to the apparatus main body.

3. The image forming apparatus according to claim 1, further comprising an urging member that biases the image bearing roller and the developer bearing roller in a direction in which the image bearing roller and the developer bearing roller approach each other.

4. The image forming apparatus according to claim 1, further comprising a guide configured (i) to guide one of the first unit and the second unit in the direction in which the process cartridge is attached to the apparatus main body and (ii) to position the guided one unit in a direction perpendicular to the direction in which the process cartridge is inserted into the insertion opening.

5. The image forming apparatus according to claim 1, wherein the part of the process cartridge is included in the second unit.

6. The image forming apparatus according to claim 1, wherein the process cartridge is one of a first process cartridge and a second process cartridge, and wherein the preventing portion partitions the insertion opening into a first insert area for an insertion of the first process cartridge and a second insert area for an insertion of the second process cartridge.

7. A process cartridge attachable to and detachable from an apparatus main body of an image forming apparatus, the apparatus main body including an insertion opening into which the process cartridge is inserted and a preventing portion, the process cartridge comprising:

a first unit in which an image bearing roller for bearing a developer image is supported rotatably; and a second unit in which a developer bearing roller for bearing developer is supported rotatably, the second unit being connected to the first unit to be rotatable with respect to the first unit;

wherein the process cartridge is capable of having a first state in which the image bearing roller and the developer bearing roller contact each other and a second state in which the image bearing roller and the developer bearing roller are spaced from each other, and wherein the process cartridge includes a contacted portion provided in one of the first unit and the second unit, wherein the contacted portion of the process cartridge in the second state is contacted by the preventing portion of the apparatus main body so that the process cartridge in the second state is prevented from being inserted into the insertion opening, and the contacted portion of the process cartridge in the first state is not contacted by the preventing portion of the apparatus main body so that the process cartridge in the first state is allowed to be inserted into the insertion opening, and wherein the process cartridge is configured to be inserted into the insertion opening in a direction of a rotational axis of the image bearing roller, and the contacted portion of the process cartridge is arranged (i) so as to overlap, when viewed in the direction of the rotational axis of the image bearing roller, with the preventing portion of the apparatus main body when the process cartridge is in the second state, and (ii) so as not to overlap, when viewed in the direction of the rotational axis of the image bearing roller, with the preventing portion of the apparatus main body when the process cartridge is in the first state.

8. The process cartridge according to claim 7, wherein the contacted portion is provided in the second unit.

* * * * *